US005819770A

United States Patent [19]

Randall et al.

[11] Patent Number: 5,819,770

[45] Date of Patent: Oct. 13, 1998

[54] CLEANING APPARATUS WITH SOLUTION FLUSHING SYSTEM FOR TUBES AND OTHER ARTICLES

[75] Inventors: Frederick Randall, Montclair; Alfred J. Raven, III, Morganville, both of N.J.

[73] Assignee: Randall Manufacturing Co., Hillside, N.J.

[21] Appl. No.: 772,695

[22] Filed: Dec. 23, 1996

[51] Int. Cl.[6] ..... B08B 3/04

[52] U.S. Cl. ..... 134/57 R; 134/58 R; 134/147; 134/155; 134/169 R; 134/186

[58] Field of Search ..... 134/57 R, 58 R, 134/147, 148, 155, 169 R, 169 C, 186

[56] References Cited

U.S. PATENT DOCUMENTS

| | | | |
|---|---|---|---|
| 3,432,383 | 3/1969 | Russell . | |
| 3,537,897 | 11/1970 | Kington . | |
| 3,850,692 | 11/1974 | Van Allman et al. | 134/8 |
| 4,419,141 | 12/1983 | Kunkel | 134/22.12 |
| 4,444,596 | 4/1984 | Gortz et al. | 134/18 |
| 4,863,555 | 9/1989 | John, Jr. et al. | 134/22.11 X |
| 4,874,002 | 10/1989 | Sunhholm | 134/111 |
| 4,899,767 | 2/1990 | McConnell et al. | 134/186 X |
| 5,007,444 | 4/1991 | Sundholm | 134/166 X |
| 5,275,668 | 1/1994 | Dell et al. | 134/186 X |
| 5,284,523 | 2/1994 | Badami et al. | 134/18 |
| 5,289,837 | 3/1994 | Betancourt | 134/57 R |
| 5,291,626 | 3/1994 | Molnar et al. | 8/158 |
| 5,299,587 | 4/1994 | Randall et al. | 134/111 |
| 5,322,571 | 6/1994 | Plummer et al. | 134/22.12 |

*Primary Examiner*—Philip R. Coe
*Attorney, Agent, or Firm*—Plevy & Associates

[57] ABSTRACT

A fuzzy logic based control method adjusts the pump speed of a cleaning apparatus in which tubes or other article are located in a tank of cleaning solution. The tank has a circulation system with a discharge header for directing the cleaning solution at the tubes and a suction header for pulling fluid from the tank. The circulation system has a variable speed pump for circulating the fluid. A funnel directs the flow from the tubes towards the suction header. A fuzzy logic controller is used to determine when the pump speed may be stablized at a cleaning speed creating the proper flow of a cleaning solution through the tubes. The fuzzy logic controller utilizes a novel algorithm to determine the proper pump speed which uses fuzzy input variables for the input flow, the output flow, and the amplitude of the difference. In terms of the fuzzy lingistic variables, the input flow, the output flow, and the amplitude, the fuzzy rule for determining the proper pump speed may be expressed as "if input flow is right, output flow is right, and amplitude of the difference is small, then the pump is running at the proper speed" and the cleaning cycle can proceed.

18 Claims, 8 Drawing Sheets

CLEANING APPARATUS WITH SOLUTION FLUSHING SYSTEM FOR TUBES AND OTHER ARTICLES

FIELD OF THE INVENTION

The invention relates to a cleaning apparatus and method used in cleaning parts having apertures by a flow of liquid through the aperture, and more particularly to a cleaning apparatus and method using fuzzy logic control for cleaning tubes and other articles such as machine housings in an aqueous solutions.

BACKGROUND OF THE INVENTION

Tubes are typically cleaned internally after machining and before use in a system to remove contaminating particles remaining after the manufacture. One generally accepted method is to connect each end of the tube to a tube or pipe flushing apparatus and send a flushing liquid and or air through the tube from one portion of the flushing apparatus to the other portion of the flushing apparatus through the tube. This system is effective but inefficient when there are numerous tubes to clean. It is extremely time consuming to attach and detach each tube to the apparatus, and typically only one tube can be cleaned at a time. It is therefore desired to find a more efficient method.

Immersion cleaning devices are widely used in many different industries to clean and/or chemically treat a variety of manufactured products. Immersion cleaning devices are commonly used to clean newly manufactured parts after a machining operation, wherein the machining operation contaminates the parts with residual machining oils, machine chips, or other debris.

Immersion cleaning devices operate by immersing contaminated parts in a cleaning solution. The contaminated parts and/or cleaning solution is then agitated to provide the needed cleaning action. The cleaning solution used within the immersion cleaning device depends upon what contaminant is to be removed from a particular object. Such solutions are typically water-based solutions used in conjunction with detergents due to environmental concerns.

In addition, in a manufacturing environment, where it is desirable to clean a large number of parts at one time, parts are conventionally grouped into batches. A batch of parts is then entered into the immersion cleaning device where all the parts in the batch are cleaned simultaneously. Since immersion cleaning devices are used to clean a large variety of objects, such devices conventionally come equipped with wire mesh baskets or containers. These containers are sized to fit properly within the immersion cleaning device. The containers are filled with the batch of parts to be cleaned and are used to confine the movement of the parts during the cleaning procedure. This also allows multiple containers to be filled with batches of parts in advance, so that the containers can be quickly loaded into and unloaded from the immersion cleaning device. Consequently, the amount of downtime experienced by the immersion cleaning device is reduced and more parts can be cleaned in a given period of time.

There is a large variety of techniques for producing agitational movement within various prior art immersion cleaning devices. A common agitational movement is that of vertical reciprocation, wherein the contaminated parts are repeatedly cycled up and down within the cleaning solution. In such prior art immersion cleaning devices, contaminated parts are placed upon a platform, which is then rapidly vertically reciprocated within the cleaning solution. The movement of the container of parts and the platform within the cleaning solution agitates the cleaning solution thereby adding to the cleaning operation.

Using a purely vertical reciprocal movement is not highly effective in removing contaminants and debris from parts that have blind holes and other depressions on the surfaces of the parts being cleaned. To improve the agitation of parts within immersion cleaning devices, immersion cleaners have been developed that rotate the contaminated parts within the cleaning solution. U.S. Patent No. 5,299,587 describes an apparatus that uses both a reciprocating and a rotational agitating movement to clean the parts and further provides a transfer system wherein the parts being cleaned can be efficiently transferred between separate machines. U.S. Patent No. 5,299,587 is herein incorporated by reference. While this method is effective for shallow holes and depressions, it is not effective for holes having large length to diameter ratios, such as a tube.

It would be desirable to have an apparatus and method for cleaning batches of tubes or pipes, or other articles. In addition, it would be desirable to have a method which adjusts the cleaning process based on conditions associated with the cleaning.

SUMMARY OF THE INVENTION

A method is provided for controlling the pump speed of a cleaning apparatus in which tubes or other articles are located in a tank of cleaning solution. The tank has a circulation system with a discharge header for directing the cleaning solution at the tubes and a suction header for pulling fluid from the tank. The circulation system has a variable speed pump for circulating the fluid. A funnel directs the flow from the tubes towards the suction header. A fuzzy logic controller is used to determine when the pump speed may be stabilized at a cleaning speed creating the proper flow of a cleaning solution through the tubes. The fuzzy logic controller utilizes a novel algorithm to determine the proper pump speed which uses fuzzy input variables for the input flow, the output flow, and the amplitude of the difference. In terms of the fuzzy linguistic variables, the input flow, the output flow, and the amplitude, the fuzzy rule for determining the proper pump speed may be expressed as "if input flow is right, output flow is right, and amplitude of the difference is small, then the pump is running at the proper speed" and the cleaning cycle can proceed.

One object, feature, and advantage resides in the funnel for directing the flow from the tubes towards the suction header having a flow meter for measuring the output flow of the tubes.

In an alternative embodiment, the fluid enters the tank at a second input port and the funnel directs the flow from the tubes towards the suction header, therein pulling the fluid through the tubes.

In another preferred embodiment, the funnel is removed and the fluid enters the tank through the discharge header, the first input header, and is directed towards the tubes, therein pushing the fluid through the tubes.

Further objects, features, and advantages of the present invention will become more apparent to those skilled in the art as the nature of the invention is better understood from the accompanying drawings and detailed descriptions.

BRIEF DESCRIPTION OF THE DRAWINGS

For the purpose of illustrating the invention, there is shown in the drawings a form which is presently preferred.

it being understood, however, that this invention is not limited to the precise arrangements and instrumentalities shown.

DETAILED DESCRIPTION OF THE PREFERRED EMBODIMENT

Figure 1:
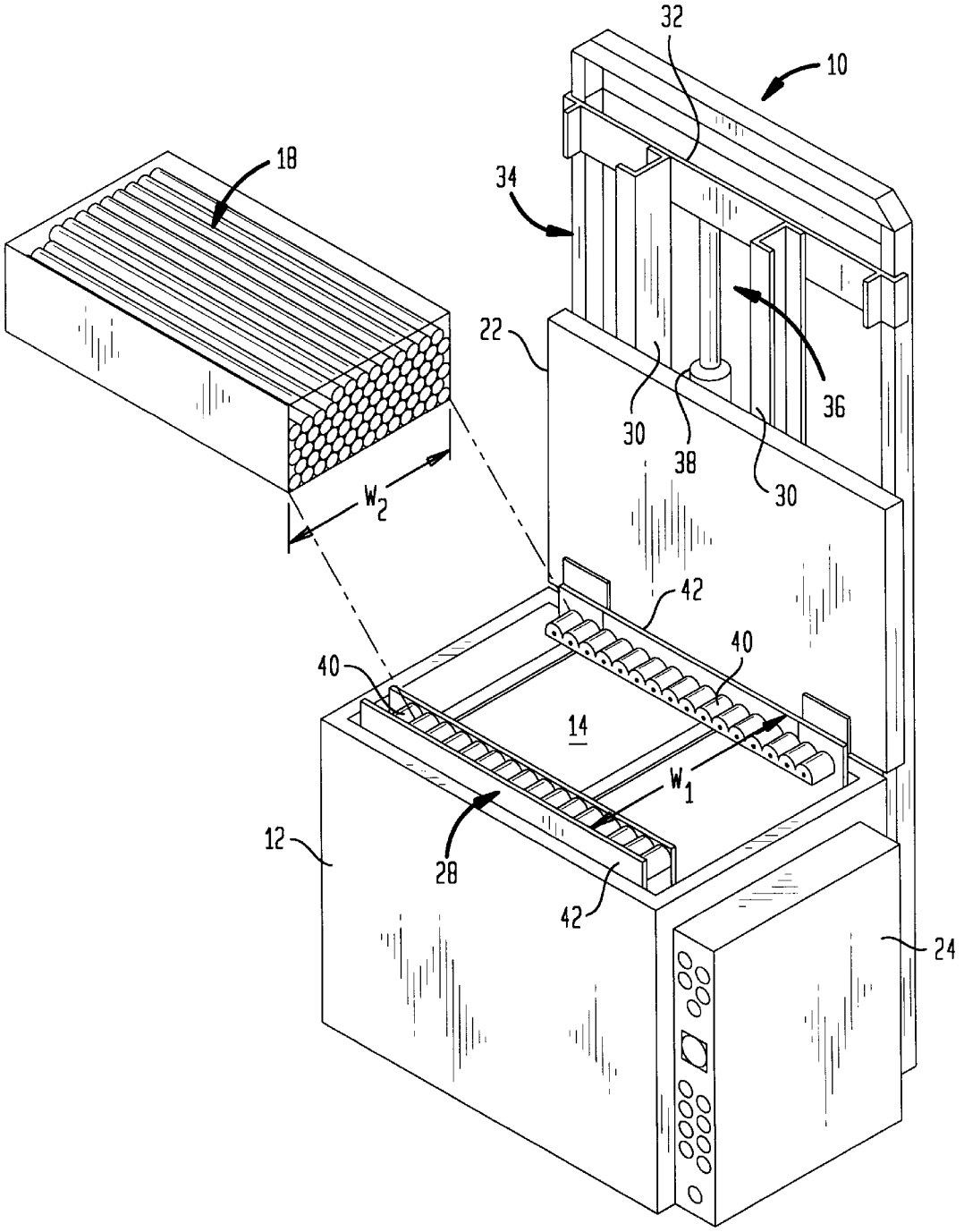
FIG. 1 is a perspective view of a tube cleaner apparatus, an immersion cleaning apparatus, constructed in accordance with one preferred embodiment of the present invention.

Referring now to the drawings, wherein like numerals indicate like elements and where prime (') indicates counterparts of such like elements, there is illustrated in FIG. 1 a device in accordance with the present invention designated generally as 10.

The cleaner apparatus 10, also referred to as an immersion cleaning machine, has a tank 12, or like reservoir, which accommodates a volume of cleaning solution 14. The tank has an elevator assembly 16 which receives a basket 18 containing a plurality of articles 20, such as tubes, to be cleaned. The tank 12 has a lid 22 which may be closed over the tank 12, thereby reducing heat loss from the cleaning solution 14 and reducing evaporation of cleaning solution 14. The cleaner apparatus 10 has a control unit 24 as explained in further detail below.

Still referring to FIG. 1, the elevator assembly 16 has an elevator platform 28 which is secured to two elongated support members 30. A crossbar member 32 joins the two elongated support members 30 on one side. The two elongated support members 30 are parallel, such that the crossbar member 32 is secured to each of the support members 30 at a perpendicular. An elevator guide framing 34 extends above the tank. The crossbar member 32 engages the elevator guide framing 34 and is reciprocally movable up and down along the elevator guide framing 34. Consequently, as the crossbar member 32 is moved up and down along the elevator guide framing 34, the elongated support members 30 reciprocally move within the tank 12, raising and lowering the elevator platform 28.

An elevator drive assembly 36 engages the crossbar member 32 and controls the reciprocal movement of the crossbar member 32 along the elevator guide framing 34. The elevator drive assembly 36 can include any conventional mechanical, pneumatic, and/or hydraulic elevator drive. However, in the preferred embodiment, the elevator drive assembly 36 is a pneumatic cylinder 38 secured to the center of the crossbar member 32 and operating to move the crossbar member 32 up and down the elevator guide framing 34 by the reciprocating action of the cylinder 38. The range of movement embodied by the pneumatic cylinder 38 enables the elevator platform 28 to be raised into the same plane as the open top of the tank 12. Similarly, the range of the pneumatic cylinder 38 also enables the elevator platform 28 to be lowered into the tank 12 well below the surface of the cleaning solution 14.

The elevator platform 28 includes two parallel rows of rollers 40. Guide rails 42 extend upwardly from the sides of the rows of the roller 40 thereby defining the sides of a channel having a width W1. The width W1 of the channel defined by the guide rails 42 is slightly larger than the width W2 of the basket 18. Similarly, the length of the rows of the rollers 40 are slightly longer than the length of the basket 18. Consequently, the basket 18 can be pushed onto, and advanced across, the rollers 40, wherein the guide rails 42 will guide the orientation of the basket 18 and enable the basket 18 to properly align above the tank 12. In a preferred embodiment, the row of rollers 40 and guide rail 42 located closest to the elongated support member 30 has its end portions split from the remaining portion for reasons that will become evident.

Figure 2:
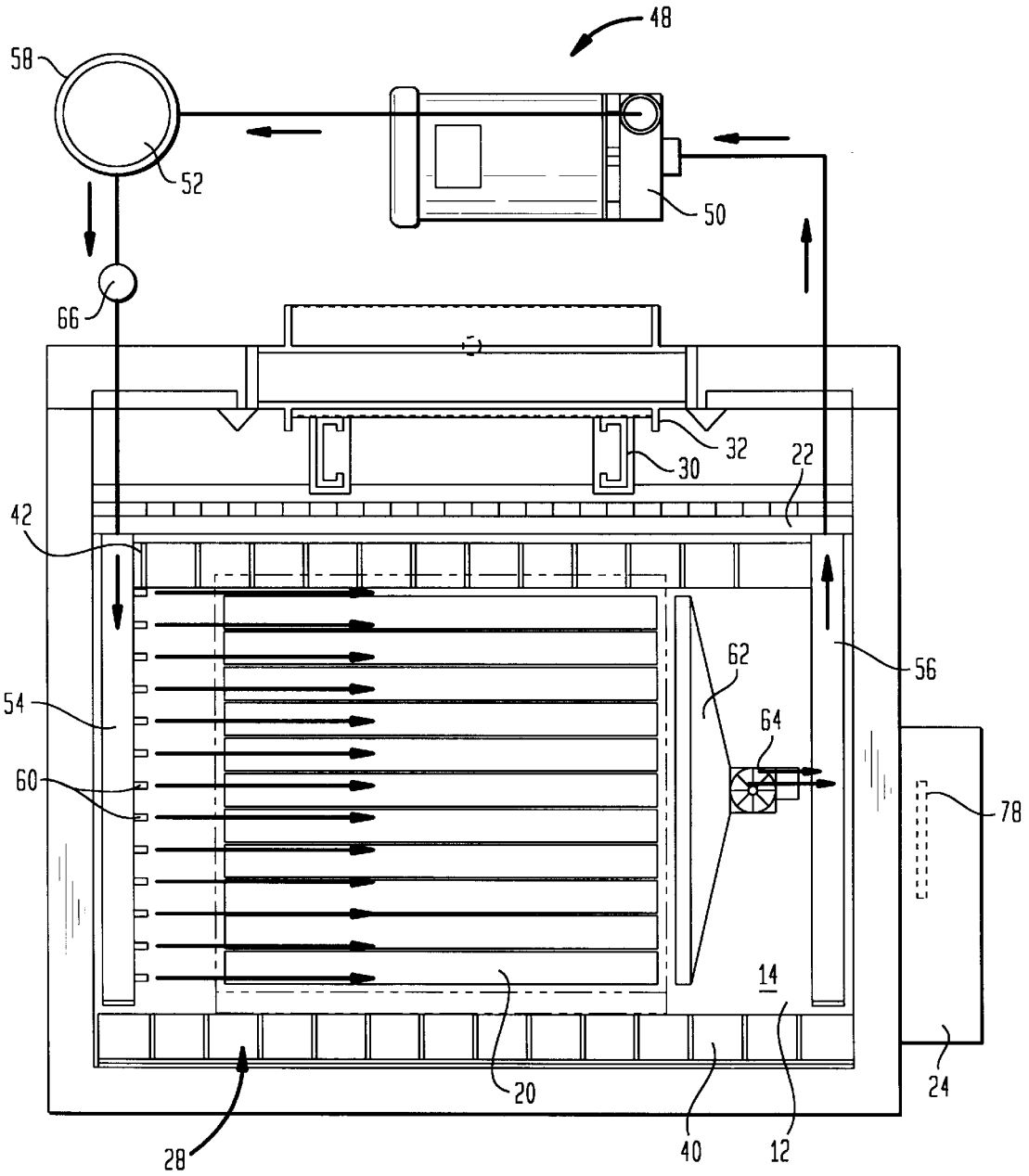
FIG. 2 is a plan view of a tube cleaner apparatus according to the invention.

Referring to FIG. 2, the cleaner apparatus 10 has a circulation system 48 having a variable speed pump 50, a filter 52, and a discharge header 54 and a suction header 56. The pump 50 receives its feed from the suction header 56 and pumps the cleaning solution 14 through the filter 52 located in a filter housing 58 to the discharge header 54. The discharge header 54 has a series of discharge nozzles 60 for directing the flow towards the tubes 20. The piping between elements of the circulation system 48 are shown symbolically.

In a preferred embodiment, the nozzles 60 each have an opening of an ⅛ of an inch to ½ an inch in diameter. The nozzles 60 are uniformly spaced apart and typically spaced between 2 and 3 inches depending on the nozzle diameter and distance to the tubes 20. The nozzles 60 create a uniform spray pattern. It is recognized that the discharge header 54 could be replaced with a discharge header 54 having the nozzles spaced differently and/or nozzle openings dependent on the size of the tube that is going to be cleaned.

The cleaner apparatus 10 has a suction funnel 62 or channel acting as a fluid directing means for directing the flow out of the tubes towards the suction header 56. The suction funnel 62 has a generally rectangular opening which faces the tubes and a smaller generally circular opening which faces the suction header 56. The suction funnel 62 has a flow meter 64 for determining the flow exiting the tubes 20 as explained below.

The circulation system 48 has a pressure transducer 66 interposed between the filter 52 and the discharge header 54 for determining the pressure of the fluid (i.e., the cleaning solution 14) through the circulation system 48. It is recognized that the pressure transducer 66 could instead be a flow meter similar to that in the suction funnel 62. Both the flow meter 64 and the pressure transducer 66 are connected to the control unit 24.

Still referring to FIG. 2, the two parallel rows of rollers 40 and the guide rails 44 of the elevator platform 28 locate the basket 18 containing the plurality of tubes 20 between the discharge nozzles 60 and the suction funnel 62. The row of rollers 40 which is closer to the elongated support member 30 is designed such that the major portion can move up and down past the discharge header 54 and the suction header 56 without hitting the headers 54 and 56. The lid 22 is shown in an open position just forward (downward in the Figure) of its hinge.

Figure 3:
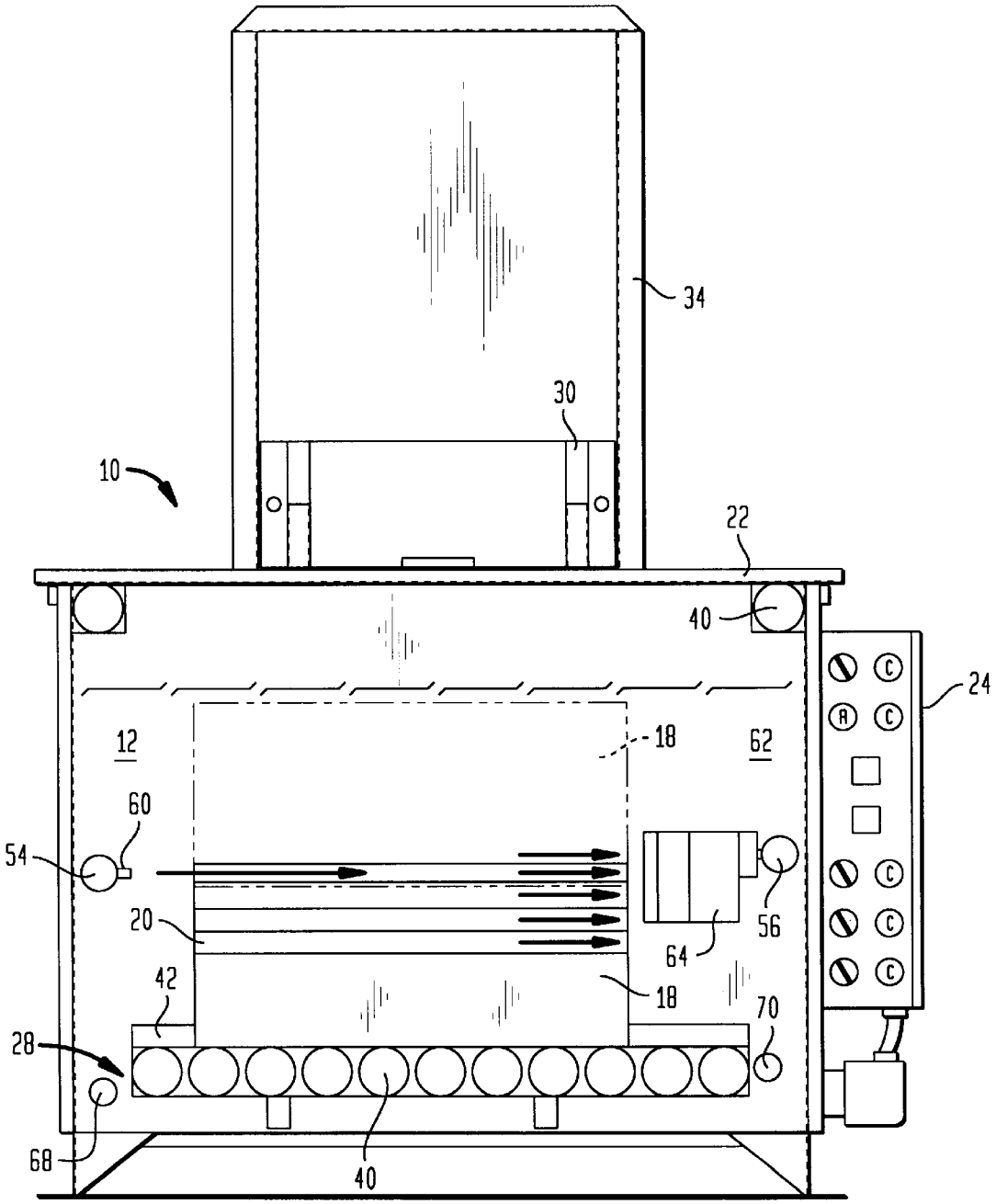
FIG. 3 is a front view of the tube cleaner apparatus.

A front sectional view of the cleaner apparatus 10 is shown in FIG. 3. The discharge header 54 has a single row of the discharge nozzles 60 which is shown aligned with the top row of tubes 20 in this Figure. The suction header 56 is shown slightly higher than the discharge header 54. The suction funnel 62 for directing the flow of cleaning solution 14 out of the tubes 20 has a height which is equivalent to several rows of tubes 20. The fluid that flows through the tubes is directed through the suction funnel 62 where it passes through the flow meter 64. It is recognized that the suction header 56 could be at the same height as the discharge header 54, but is raised slightly to improve circulation.

In addition, the circulation system 48 has a second tank input port 68 in addition to the discharge header 54, and a second tank output port 70 in addition to the suction header 56. The input port 68 and the output port 70 are shown located in the lower level of the tank 12. The input port 68 and the output port 70 are connected to the rest of the circulation system 48 with a valving arrangement 72 and 74, respectively, such that the discharge header 54 or the second tank input port 68 can be alternatively selected, or both can be selected, as explained below. Likewise, the suction header 62 or the second tank output port 70 can be alternatively selected, or both can be selected.

The rollers 40 of the elevator platform 28 upon which the basket 18 is resting are shown in a down agitating position. The row of rollers 40 and guide rail 42 shown, which is the one located closest to the elongated support member 30, has its end portions split from the remaining portion to allow the major portion of the row of rollers 40 to move up and down past the discharge header 54 and the suction header 56. The end portions of the row of rollers 40 are fixed at the top, and used for moving the basket 18 onto and off the portion of the row of rollers 40 which moves up and down.

The basket 18 is shown in phantom in an up agitating position in which the discharge nozzles 60 are aligned with the bottom row of tubes 20 in the basket 18. In a preferred embodiment, the entire basket 18 is below the level of the cleaning solution 14 for the entire cleaning cycle as described below. It is, however, recognized that the tank 12 could be of such a height that the entire basket 18 could be removed from the cleaning solution 14 to allow the tubes 20 to drain during the cleaning cycle.

Still referring to FIG. 3, the elongated guide framing 34 supports the elongated support members 30 of the elevator assembly 16. The lid 22 is shown in a lowered position. The elongated support members 30 enter the tank 12 aft of the lid 22 such that the lid 22 does not interfere with the movement of the elevator platform 28. The control unit 24, which is located on the side of the tank 12, has a plurality of switches and push buttons. In addition, the control unit 24 has a plurality of output devices, preferably digital displays and lights, which will be discussed below.

Figure 4:
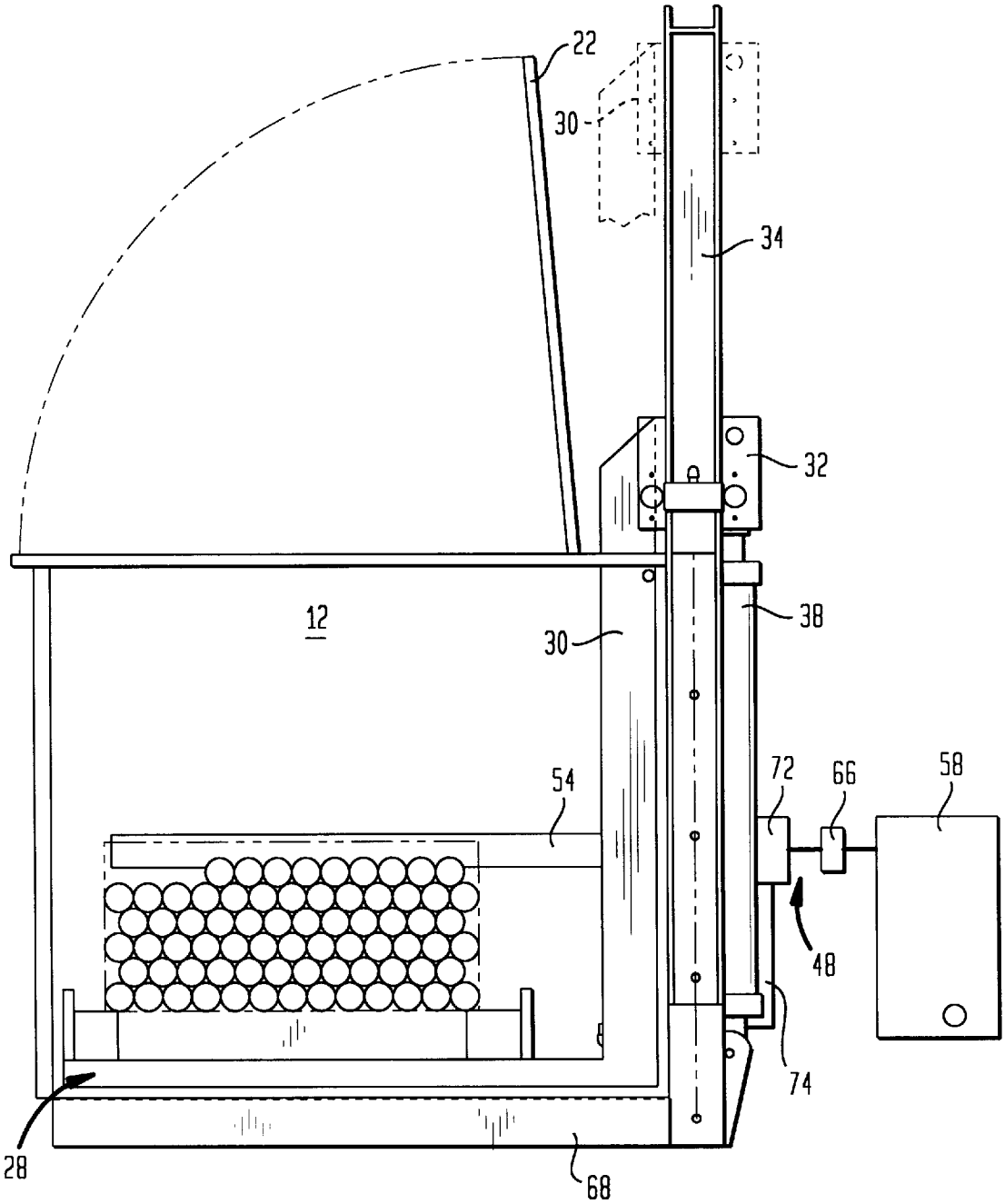
FIG. 4 is a end view of the tube cleaner apparatus taken along the line 4—4 in FIG. 3.

The elongated support members 30 enter the tank 12 aft of the lid 22 such that the lid 22 does not interfere with the movement of the elevator platform 28, as shown more clearly in FIG. 4. The elongated support members 30 are shown in hidden line in a raised transfer position. The pneumatic cylinder 38 for moving the crossbar member 32 up and down the elevator guide framing 34 is seen. The range of movement embodied by the pneumatic cylinder 38 enables the elevator platform 28 to be raised into the same plane as the open top of the tank 12, as seen in FIG. 1, and to be lowered into the tank 12 well below the surface of the cleaning solution 14 as seen in FIGS. 3 and 4. The filter housing 58 and the pressure transducer 66 of the circulation system 48 are shown behind (to the right in the Figure) the tank 12.

Figure 5:
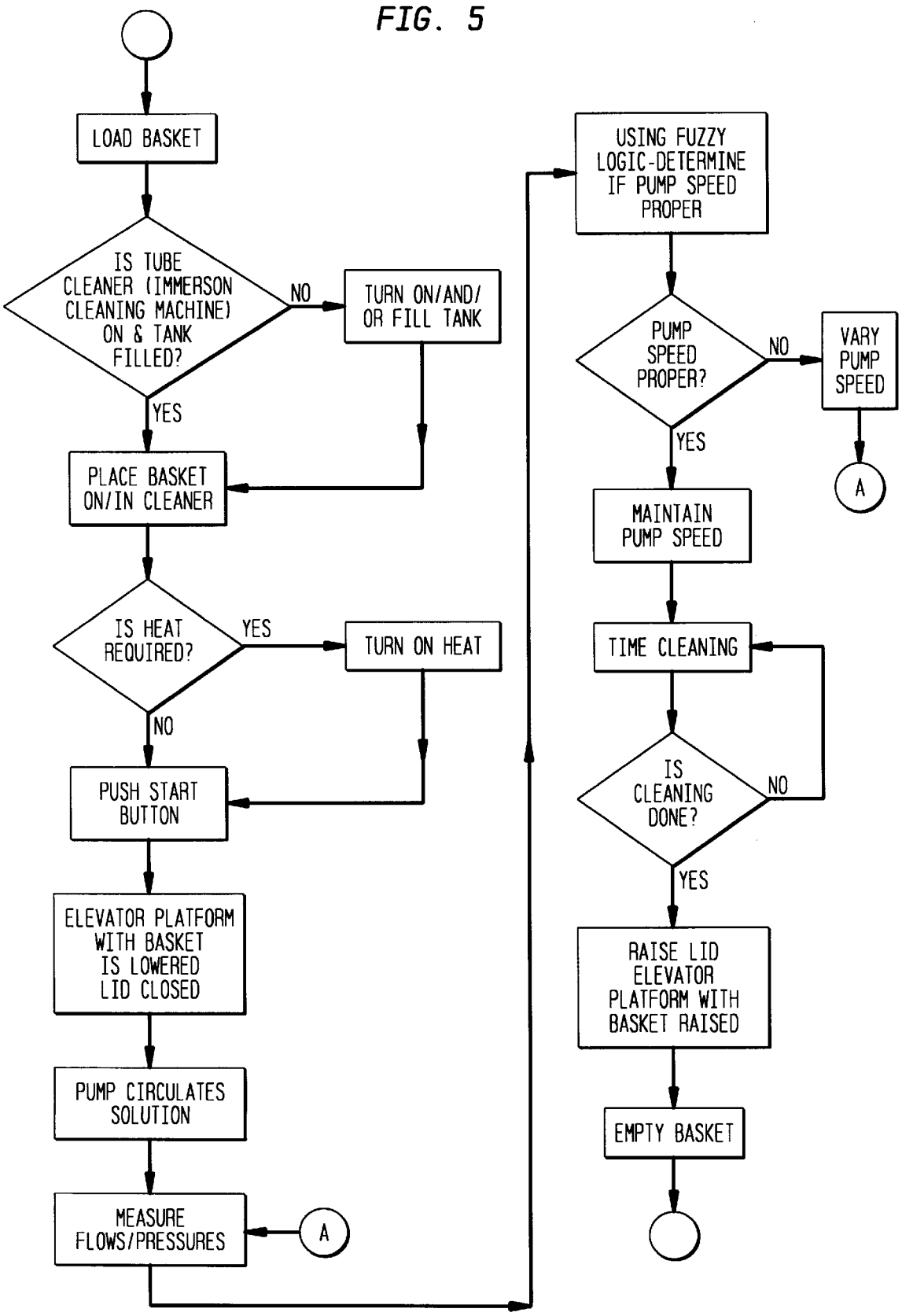
FIG. 5 shows a flow diagram of the method of cleaning the tubes according to the invention.

FIG. 5 shows a flow chart of the process to clean the tubes. The basket 18 is loaded with tubes 20; the loading of the basket 18 can be done remote from the immersion cleaning machine 10 and the immersion cleaning machine 10 can be cleaning a previously loaded basket. With the lid 22 of the tank 12 open, the basket 18 is placed onto the elevator platform 28, as seen in FIG. 1. The elevator platform 28, the support members 30, and the crossbar member 32 of the elevator assembly 18 are at their highest elevated point, and are ready to descend in order to immerse the basket 18 into the tank 12.

A predetermined volume of cleaning solution 14 is within the tank. With the panel power switch on, the operator pushes a cycle start push button located on the control unit 24. If desired, the operator can turn on a heating unit by rotating a heat selection switch located on the control unit 24. The heating unit, typically an electric heater, heats the cleaning solution 14 in the tank 12. A digital display on the control unit 24 can show the desired or actual temperature in the tank 12.

The basket 18 is lowered into the tank to a position shown in FIGS. 3 and 4. To lower the basket 18 into the tank, the elevator platform support member 30 are lowered into the tank by lowering the position of the crossbar member 32 on the elevator guide framing. Once lowered to a proper depth, the lid 22 is closed by the lid lift cylinder, not shown, and the basket 18 is sealed within the tank 12. The lowering of the basket 18 and the lid 22 is controlled by a central processing unit 78 located in the control unit 24 (shown schematically in FIG. 2).

The basket 18 is positioned in the tank 12 such that the nozzles 60 of the discharge header 54 are generally aligned vertically with the centerline of the top row of tubes 20 in the basket 18. The cleaning solution 14 enters the tank 12 through the discharge header 54 and is drawn out of the tank 12 through the section header 56. This mode of operation is referred to as a push/pull mode, since the fluid, the cleaning solution 14, is pushed towards the tubes by the discharge header 54 and pulled from the tubes by the suction header 56.

The central processing unit located in the control unit 24 ramps up the speed of the variable speed pump 50. The flow meter 64 and the pressure transducer 66 are read essentially continuously as the pump increases the flow through the circulation system 48. The central processing unit 78 uses a fuzzy logic controller to determine the proper pump 50 speed.

Figure 6:
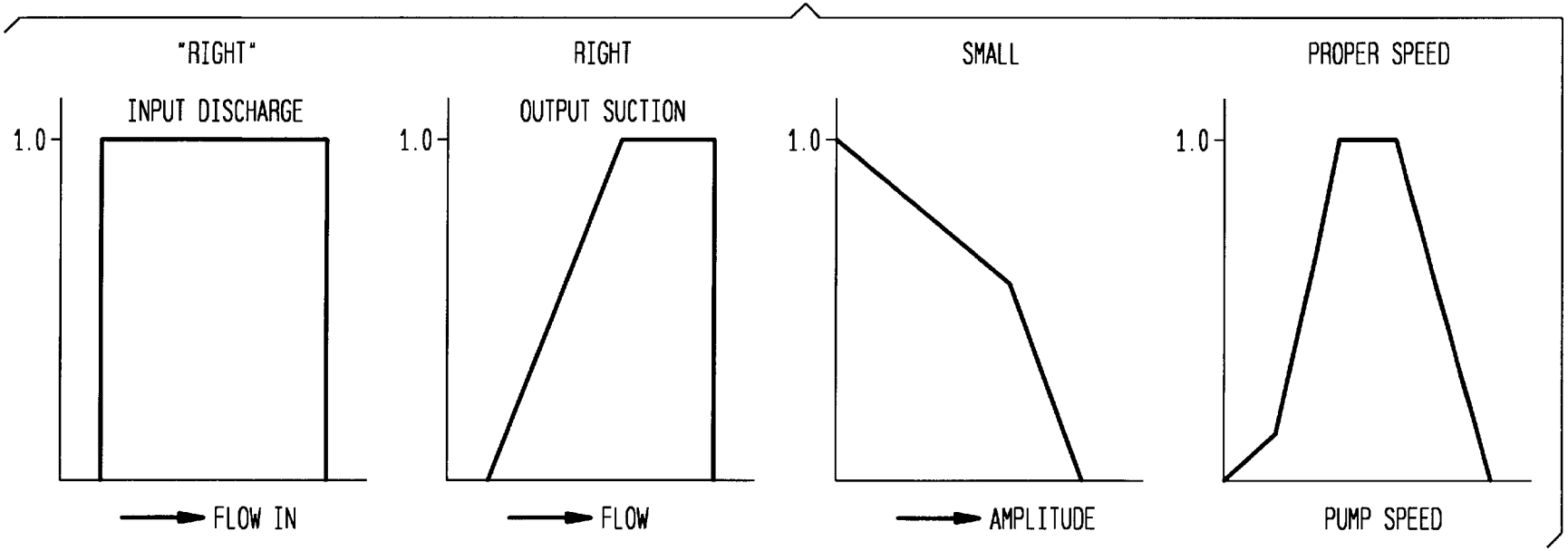
FIG. 6 illustrates the fuzzy inference process of the present invention.

FIG. 6 shows the fuzzy inference process. The fuzzy membership functions are defined over input flow, output flow, and amplitude. The functions define ranges over which the variable inputs will be fuzzified as right, right and small, respectively. The fuzzy rule is "IF INPUT FLOW IS RIGHT, OUTPUT FLOW IS RIGHT, AND AMPLITUDE OF DIFFERENCE IS SMALL THEN PUMP RUNNING AT PROPER SPEED." This rule returns a value, when it is executed, which corresponds to the degree to which all three antecedents "input flow", "output flow," and "amplitude" are satisfied by the scalar input values corresponding to the fuzzy variables. The value returned in the variable "proper speed" is the minimum of the degrees of fulfillment of the three antecedent fuzzy variables. The control algorithm can use an arbitrary threshold, such as 0.5, on the values of "pump speed" to decide when to hold the pump at that speed for the cleaning cycle. Those skilled in the art will realize that there are many design choices which can be made in the implementation of fuzzy logic and the present invention is not limited to any of these including exact term set shapes, degree-of-matching rules, and defuzzification methods. One of the novelties of the present invention is in the use of signals which can be used to represent the drop of pressure across the tubes and particularly in the use of fuzzy logic to know when the input flow is right (within a certain range), the output flow is right (within a certain range), and the difference is minimized (however defined).

Upon the fuzzy logic determining the proper speed of the variable speed pump 50, the central processing unit 78 moves the elevator platform 28 with the basket 18 of tubes 20 up and down from an uppermost cycle point to a lowermost cycle point. In a preferred embodiment, the elevator platform 28 moves continuously in the up and down motion. It is recognized that central processing unit 78 could have the elevator platform 28 move in an incremental motion, such that the discharge nozzles 60 align with each row of tubes 20. In either situation, the single line of discharge nozzles creates a knife-like flow at the tubes.

Upon completion of a cleaning cycle, the central processing unit 78 automatically raises the lid 22 and raises the elevator platform 28 of the elevator assembly 16. The basket 18 of tubes 20 can then be moved to a rinse station, not shown, if desired or the basket 18 with tubes 20 can be moved to a station for unloading.

The control unit 24, in addition to the buttons and switches discussed above in a preferred embodiment, has a power switch and an emergency stop push button . The control unit also has a run/stand-by switch, which is typically in the run position. However, when it is desired to close the lid 22 when a cleaning cycle is not operating, the switch is moved to the stand-by position wherein the elevator platform 28 and the lid 22 both are lowered. This position minimizes evaporation and prevents objects from entering the tank. In addition, the control unit also has a filter switch to manually shut off the variable speed pump 50.

In addition to the push/pull mode described above, the cleaning apparatus 10 can be used in a pull mode. In the pull mode, the cleaning solution 14 enters the tank 12 through the second tank input port 68, not the discharge header 54, therefore the fluid is not forced at the opening of the tube. The fluid, the cleaning solution 14, is drawn out of the tank 12 through the section header 56. This mode of operation is referred to as a pull mode, since the fluid is pulled from the tubes by the suction header 56.

While not shown in the Figures, it is recognized that the control unit 24 could have a keypad or other data entry form, including an optical wand, for entering information concerning the article to be cleaned. For example, the size of the tubes 20 in the basket 18 could be entered. The central processing unit 78 could use that information to determine the rate at which the elevator platform 28 moves up and down with the basket 18 or the position in which the basket 18 is stopped momentarily in the cleaning cycle such that the nozzles 60 are positioned relative to the tubes.

Figure 7:
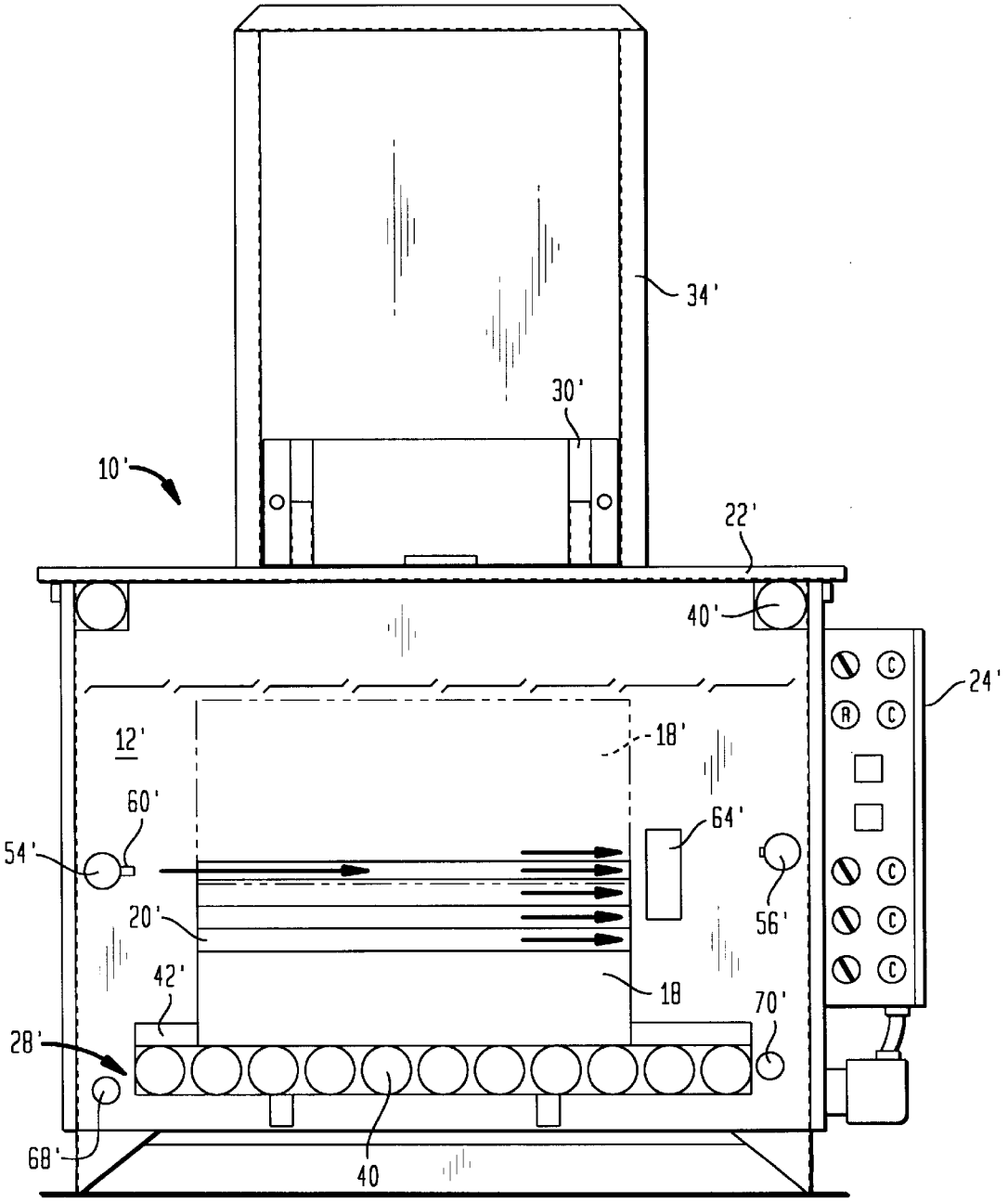
FIG. 7 shows a front view of an alternative embodiment of the cleaner apparatus.

A front sectional view of an alternative embodiment of the cleaner apparatus 10' is shown in FIG. 7. Similar to the first embodiment, the discharge header 54' has a single row of discharge nozzles 60' which is shown aligned with top row of tubes 20'. In contrast to the first embodiment, there is no suction funnel 62 for directing the flow of cleaning solution 14'out of the tubes 20'. The cleaning apparatus has a flow meter 64' located at the end of the tubes 20' for measuring the flow out of the tubes.

The suction header 56' is located in the same location as in the first embodiment, slightly higher than the discharge header 54'. In contrast to the first embodiment, the circulation system is drawing the cleaning solution out of the second tank output port 70'. It is recognized that the circulation system can be drawing out of both the discharge header 54 and the second tank output port 70'. In this arrangement, the circulation system is said to be in a push mode pushing the cleaning solution 14' through the tubes 20' by use of the discharge header 54'.

Figure 7A:
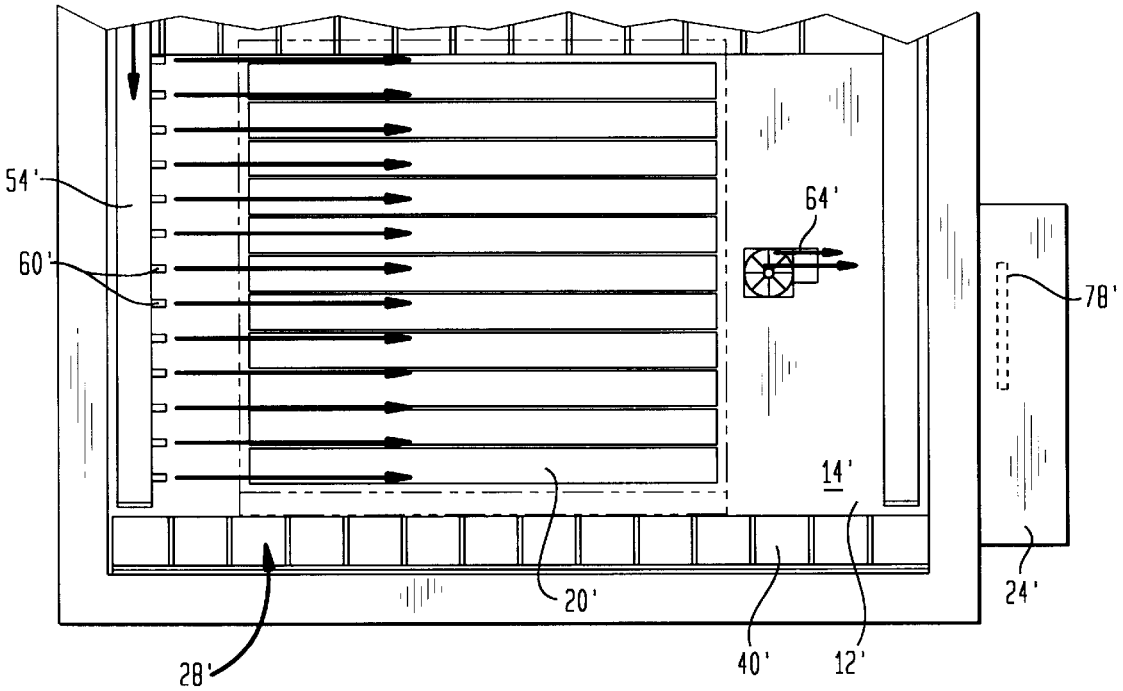
FIG. 7A shows a top view of a portion of the alternative embodiment shown in FIG. 7.

FIG. 7A shows a top view of a portion of the tank 12'. The flow meter 64' is located in front of the end of a few tubes 20' located in the center of the basket 20', and therefore measures the flow through only a few of the tubes. The flow meter 64' is positioned in the tank 12' by rods, not shown, or any other method that has a minimum effect on the flow in the tank 12'.

In this mode, the control unit 24' still monitors the flow or pressure in the circulation system using a pressure transducer 66' and the flow out of the tubes with the flow meter 64'. The central processing unit 74' in the control unit 24' uses a fuzzy logic controller similar to that described above to determine the proper pump 50' speed.

The present invention may be embodied in other specific forms without departing from the spirit or essential attributes therefore and, accordingly, references should be made to the appended claims, rather than to the foregoing specification, as indicating the scope of the invention. While the invention has been described in relation to cleaning tubes, it is recognized that other articles which would benefit from the describe flow could also be cleaned, such as machine housings, such as engine head and engine blocks, or a widget. It is recognized that other mechanisms besides the series of rollers could be used to place the basket on the elevator platform, such as a hoist. In addition, it is recognized that the fuzzy logic could "learn" from iterations to determine the proper speed of the variable speed pump and use the "learning" to effect further iterations.

It is also recognized that the central processing unit could step the variable speed pump 50 through a series of speeds, rather than a continuous ramp-up. The circulation system 48 is allowed to settle out, and the flow meter 64 and the pressure transducer 66 read before moving to the next step.

We claim:

1. An apparatus for immersing at least one object having an opening, the apparatus comprising:

object holding means for holding at least one object;

reservoir means capable of retaining a volume of fluid into which the object holding means can be completely immersed;

a circulation system having an output port for receiving fluid from the reservoir means, an input port for dispensing fluid in the reservoir means towards the opening of the object and a pump for circulating the fluid; and control means comprising a central processing unit using fuzzy logic for controlling the speed of the pump for adjusting the flow toward the at least one object.

2. An apparatus for immersing at least one object as in claim 1 wherein the object holding means is a basket having openings for allowing fluid into the basket.

3. An apparatus for immersing at least one object as in claim 2 further comprising reciprocating means for vertically reciprocating the basket within the reservoir means.

4. An apparatus for immersing at least one object as in claim 3 further comprising a cover for the reservoir means wherein the cover can be closed over the reservoir means, enclosing the basket in the reservoir means as the basket is reciprocated by the reciprocating means.

5. An apparatus for immersing at least one object as in claim 4 wherein the output port is a suction header for pulling fluid from the at least one object.

6. An apparatus for immersing at least one object as in claim 5 further comprising a fluid direction means locating in the tank interposed between the suction header and the at least one object for directing the flow from the at least one object towards the suction header.

7. An apparatus for immersing at least one object as in claim 1 further comprising a pair of measuring means for measuring the flow of the fluid and providing an input responsive thereto to said control means.

8. An apparatus for immersing at least one tube having an opening with a long length to diameter ratio, the apparatus comprising:

a basket for holding the at least one tube;

a tank capable of retaining a volume of fluid into which the basket can be completely immersed;

a circulation system having a suction header located in the tank for receiving fluid from the tank, a discharge header located in the tank for dispensing fluid in the tank toward [the tubes] said at least one tube and a variable speed pump for circulating the fluid; and control means comprising a central processing unit using fuzzy logic for controlling the speed of the pump for adjusting the flow toward the at least one tube.

9. An apparatus for immersing at least one tube as in claim 8 further comprising reciprocating means for vertically reciprocating the basket within the tank.

10. An apparatus for immersing at least one tube as in claim 9 further comprising a cover for the tank wherein the cover can be closed over the tank, enclosing the basket in the tank as the basket is reciprocated by the reciprocating means.

11. An apparatus for immersing at least one tube as in claim 8 further comprising a fluid direction means locating in the tank interposed between the suction header and the at least one tube for directing the flow from the at least one tube towards the suction header.

12. An apparatus for immersing at least one tube in claim 11 further comprising a pair of measuring means for measuring the flow of the fluid and providing an input responsive thereto to said control means.

13. An apparatus for immersing at least one tube as in claim 12 wherein the measuring means are a pressure transducer and a flow meter.

14. An apparatus for immersing at least one tube as in claim 8 further comprising a fluid direction means located in the tank interposed between the suction header and the at least one tube for directing the flow from the at least one tube towards the suction header, and a pair of measuring means for measuring the flow of fluid and providing an input responsive thereto to said control means, one of the measuring means carried by the fluid direction means.

15. An apparatus for immersing at least one tube as in claim 14 wherein the fuzzy logic for optimizing the pump speed is based on measured flows from said pair of measuring means and the difference therebetween.

16. An apparatus for immersing at least one object having an opening, the apparatus comprising:

a basket for holding the at least one object;

a tank capable of retaining a volume of fluid into which the basket can be completely immersed;

a circulation system having an output port for dispensing fluid in the reservoir, a suction header located in the tank for receiving fluid from the tank and position for pulling fluid from the at least one object, and a variable speed pump for circulating the fluid; and control means comprising a central processing unit using fuzzy logic for controlling the speed of the pump for adjusting the flow toward the at least one object.

17. An apparatus for immersing at least one object as in claim 16 further comprising a pair of measuring means for measuring the flow of the fluid and providing an input responsive thereto to said control means.

18. An apparatus for immersing at least one tube as in claim 17 wherein the central processing unit has a fuzzy logic unit for optimizing the pump speed based on the measured flows and the difference between the flows.

* * * * *